US007000337B2

(12) United States Patent
Harrington

(10) Patent No.: US 7,000,337 B2
(45) Date of Patent: Feb. 21, 2006

(54) METHOD AND APPARATUS FOR REMOVABLE SHOE WEIGHTS

(76) Inventor: Jodie Ann Harrington, 2600 Bayfront Ct., Richmond, CA (US) 94804

( * ) Notice: Subject to any disclaimer, the term of this patent is extended or adjusted under 35 U.S.C. 154(b) by 23 days.

(21) Appl. No.: 10/847,602

(22) Filed: May 17, 2004

(65) Prior Publication Data

US 2005/0252042 A1 Nov. 17, 2005

Related U.S. Application Data

(60) Provisional application No. 60/320,191, filed on May 18, 2003.

(51) Int. Cl.
*A43B 5/00* (2006.01)

(52) U.S. Cl. ..... 36/132; 36/136

(58) Field of Classification Search ..... 36/132, 36/136, 72 R; 482/79
See application file for complete search history.

(56) References Cited

U.S. PATENT DOCUMENTS 3,114,982 A * 12/1963 McGowan ..... 482/105
3,366,380 A * 1/1968 Montour ..... 482/105
3,427,020 A * 2/1969 Montour et al. ..... 482/105
3,528,652 A * 9/1970 Tarbox ..... 482/105
4,507,882 A * 4/1985 Harrell ..... 36/136
4,777,743 A * 10/1988 Roehrig, Jr. ..... 36/132
5,596,821 A * 1/1997 Solo ..... 36/136
5,671,517 A * 9/1997 Gourley ..... 24/712.1
6,449,881 B1 * 9/2002 Assaf et al. ..... 36/136
2003/0126768 A1 * 7/2003 Hutt ..... 36/136

FOREIGN PATENT DOCUMENTS

GB 2139103 A * 11/1984

* cited by examiner

*Primary Examiner*—Ted Kavanaugh
(74) *Attorney, Agent, or Firm*—Charles L. Thoeming

(57) ABSTRACT

Removable shoe weights applicable for use with any laced shoe to provide increased resistance wherein the user can increase muscle toning and caloric expenditure. The invention more particularly relates to an aesthetically pleasing, removable shoe weight having a flexible weighted mass secured by at least three attachment points to shoe laces. As such, the user can variably position the weights to be selectively worn throughout many alternative and sustained activities.

14 Claims, 2 Drawing Sheets

METHOD AND APPARATUS FOR REMOVABLE SHOE WEIGHTS

CROSS-REFERENCES TO RELATED APPLICATIONS

This United States non-provisional patent application is based upon and claims the filing date of U.S. Provisional patent application Ser. No. 60/320,191, filed May 18, 2003.

STATEMENT REGARDING FEDERALLY SPONSORED RESEARCH OR DEVELOPMENT

None.

REFERENCE TO A MICRO-FICHE APPENDIX

None.

BACKGROUND OF THE INVENTION

1. Field of the Invention

The present invention relates to removable shoe weights to be used with any laced shoe to provide increased resistance to the user to enhance muscle toning and caloric expenditure. The invention more particularly relates to a removable shoe weight having a flexible weighted mass secured by at least three attachment points to the laced shoe laces wherein the user can variably position the weights to be selectively worn throughout many alternative and sustained daily activities.

2. Description of the Related Art

A search of the prior art located the following United States patents which are believed to be representative of the present state of the prior art: U.S. Pat. No. 6,397,498 B1, issued Jun. 4, 2002, U.S. Pat. No. 5,893,223, issued Apr. 13, 1999, U.S. Pat. No. 5,632,709, issued May 27, 1997, U.S. Pat. No. 5,267,927, issued Dec. 7, 1993, U.S. Pat. No. 5,231,776, issued Aug. 3, 1993, and U.S. Pat. No. 4,997,183, issued Mar. 5, 1991.

U.S. Pat. No. 6,397,498 B1, issued Jun. 4, 2002, discloses sports shoes for physical strength training with layered soles in which metal tubes are inserted.

U.S. Pat. No. 5,893,223, issued Apr. 13, 1999, discloses removable stretch fabric footwear garments with pockets containing weights. The garments overlay various portions of the perimeter of the shoe and the garments and weights contained therein are contoured to match the shape of that portion of the shoe they overlay and are secured using VELCRO®.

U.S. Pat. No. 5,632,709, issued May 27, 1997, features removable polished metal shoe weights which slip under the shoelaces perpendicular to the longitudinal axis of the shoe.

U.S. Pat. No. 5,267,927, issued Dec. 7, 1993, discloses an exercise shoe comprising nested weight modules along the shoe bottom.

U.S. Pat. No. 5,231,776, issued Aug. 3, 1993, discloses a weighted athletic shoe with the weight elements being small metal spheres arranged in a lattice grid matrix molded to the shoe sole and sandwiched between the inner and outer shoe soles.

U.S. Pat. No. 4,997,183, issued Mar. 5, 1991, discloses an ankle weight device.

BRIEF SUMMARY OF THE INVENTION

The present invention relates to removable shoe weights to be used with any laced shoe to provide increased resistance to the user to enhance muscle toning and caloric expenditure. The invention more particularly relates to a removable shoe weight having a flexible weighted mass secured by at least three attachment points to the laced shoe laces wherein the user can wear the weights throughout many varied and sustained daily activities.

The apparatus of the present invention is formed of a packet made from resilient, flexible material and includes an internal volume to completely enclose and secure a predetermined weighted mass. The packet includes a securing VELCRO® type closure centered along the packet longitudinal axis which communicates with laced shoelaces to secure the packet bottom. The packet top provides a stitched, flattened portion with eyelets to communicate with shoelace ends and which serve to secure the packet to the shoe lace-box once the laces are tied.

The weighted mass of the present invention is similarly flexible and can include steel shot which due to its density and uniformly small particle size readily conforms to the packet configuration on the lace-box of the user's shoe.

The packet also provides a hidden and secure pocket on the packet bottom side to allow the user to insert a key or money while using the shoe weights. When the shoe weights are securely attached to the laced shoes, the storage pockets are undetectable. The pocket is also secured using a VELCRO® type closure at its top.

It is an object of the present invention to provide removable shoe weights which easily can be secured to any pair of laced shoes, or alternately with at least one weight on one shoe only, and worn while the user either performs a wide range predetermined exercise regimens or routine activities to increase strength and muscle tone and burn additional calories.

It is another object of the present invention to provide removable shoe weights which fit snugly to the lace-box of laced shoes without movement during use.

It is still another object of the present invention to provide removable shoe weights which conform to the individual user's foot arch characteristics.

It is a further object of the present invention to provide removable shoe weights which offer weight resistance without undue stress on body tissue, joints, or structure.

It is still further an object of the present invention to provide removable shoe weights which increase the user's caloric consumption during use.

Other features, advantages, and objects of the present invention will become apparent with reference to the following description and accompanying drawings.

DETAILED DESCRIPTION OF THE INVENTION

With reference to the drawings, and in particular to FIGS. 1–9, the present invention for a removable shoe weight for use in combination with a laced shoe having an axis defined by a longitudinal centerline comprises a flexible packet 10 having a longitudinal centerline aligned with the longitudinal axis of the shoe, a predetermined weighted mass 35, a method for variably positioning and securing the flexible packet means to at least three separate securing points on the shoelace of the shoe allowing adjustable positioning of the packet 10 comprising the weighted mass 35 along the shoelace once the shoelace is tied securely, and a secure, hidden pocket for hidden storage of small personal property items.

Figure 1:
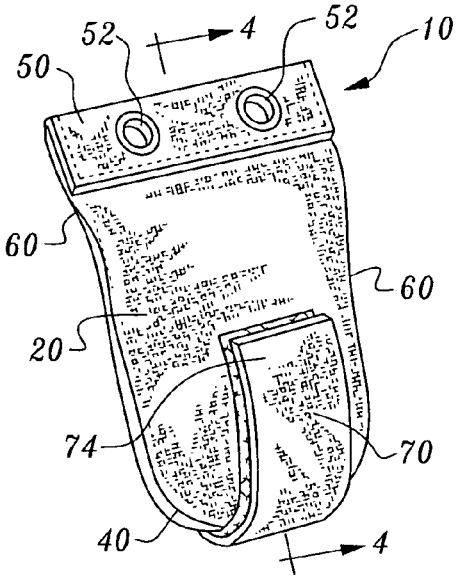
FIG. 1 is a front perspective view of an embodiment of the present invention.
Figure 3:
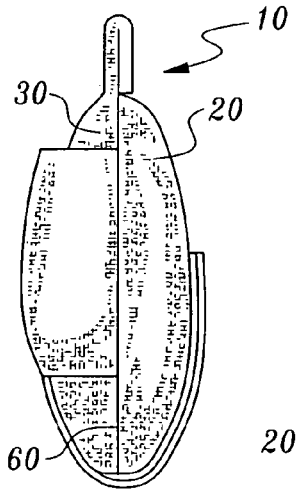
FIG. 3 is a right side perspective view of an embodiment of the present invention.
Figure 2:
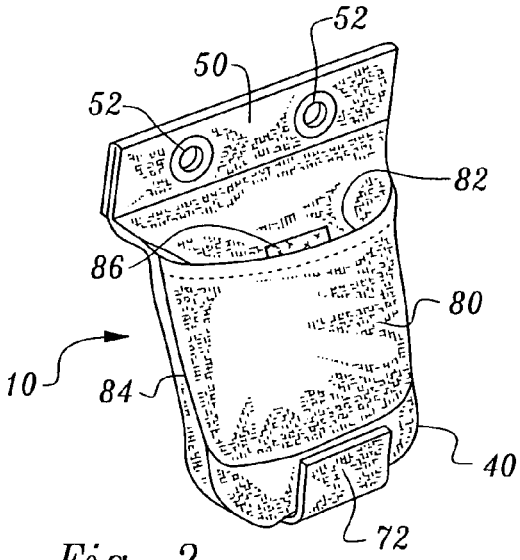
FIG. 2 is a back perspective view of an embodiment of the present invention.

The flexible packet 10 of the present invention further comprises a stitched top side 20, a stitched bottom side 30, a rounded stitched bottom 40, a flattened rectangle stitched top 50, and uniformly parallel stitched sides 60, FIGS. 1–3. The packet parallel stitched sides 60, rounded stitched bottom, and stitched top and bottom sides are sewn together to define a predetermined volume sufficient to completely enclose means for a predetermined weighted mass 35, FIG. 4.

The removable shoe weight of the present invention further comprises a method for securing the flexible packet 10 to at least three separate securing points on the lace-box of the shoe. This method and apparatus for securing the packet 10 allows adjustable positioning of flexible packet and weighted mass along the shoe lace-box, FIGS. 6–8, and secured positioning of flexible packet 10 and weighted mass 35 once the shoelace is tied securely, FIG. 9. This method and apparatus for variably positioning and securing the flexible packet 10 to at least three separate securing points on the shoe lace-box of the shoe of the present invention further comprises shoelace attachment at the packet rounded bottom 40 and shoelace attachment at the packet flattened rectangle top 50.

Shoelace attachment at the packet rounded bottom 40 further comprises a loop 70 of predetermined length having two ends, wherein one loop end 72 is fixedly attached to the packet bottom side at a point on the packet longitudinal centerline such that the length of the loop extends around the packet rounded bottom under a predetermined tied shoelace and securely attaches the other loop end 74 to a point on the packet top side longitudinal centerline, FIGS. 1–3, and 6–9.

Shoelace attachment at the packet flattened rectangle top 50 of the present invention further comprises a stitched boundary and an unbounded edge and two reinforced eyelets 52, FIGS. 1 and 2. Each eyelet 52 is spaced an equal distance from the stitched boundary and an unbounded edge and the packet longitudinal centerline, wherein each eyelet is positioned to receive a shoelace end directed from the packet bottom side 30 towards the packet top side 20 through each eyelet 52, FIGS. 8 and 9. This shoe lace positioned through the eyelets 52 allows the shoelace to be securely tied in a finished bowknot at the packet top side 20, FIG. 9. Once the bowknot is tied the packet bottom 30 is securely positioned and contoured against the tied shoelaces of the shoe lace-box along the top of the user's foot arch, FIG. 9.

Figure 4:
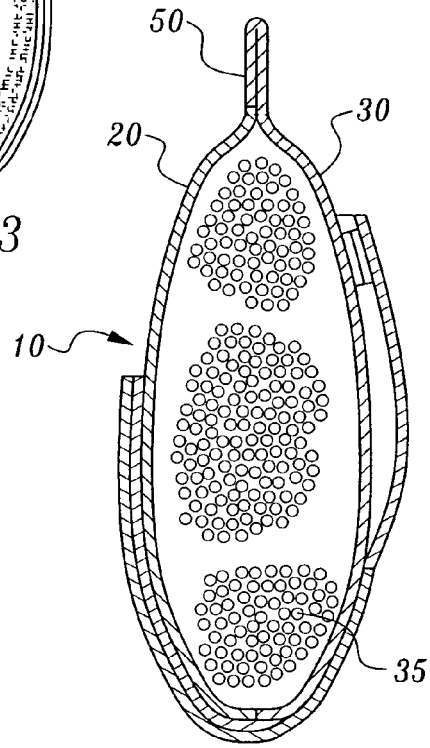
FIG. 4 is a cross-sectional view of FIG. 1 taken along the longitudinal centerline.

The predetermined weighted mass 35 of the present invention further comprises spheres, FIG. 4. The spheres can be made from ceramic or metal. The preferred embodiment of the present invention use steel pellets or steel shot as a predetermined weighted mass. The diameter of the steel pellets of the preferred embodiment of the present invention are uniformly 2–3 cm. Use of steel pellets or steel shot is critical to the flexibility of the apparatus as the packet element of the shoe weight is conformed and secured to the lace-box of the shoe and the user's foot arch, FIGS. 6–9. The density and uniformly small particle size of the pellets or shot make them more suitable than other mass means, such as sand. The predetermined weighted mass can be any weight suitable for the spirit and scope of the present invention. Typically, the weighted mass is less than one pound to one pound per each removable shoe weight. Embodiments of the present invention using weighted mass packets ranging from one-half pound to five pounds in half-pound increments can be practiced as necessary for the exercise requirements of the user. The preferred embodiment of the present invention uses one pound of weight mass per shoe weight.

Figure 5:
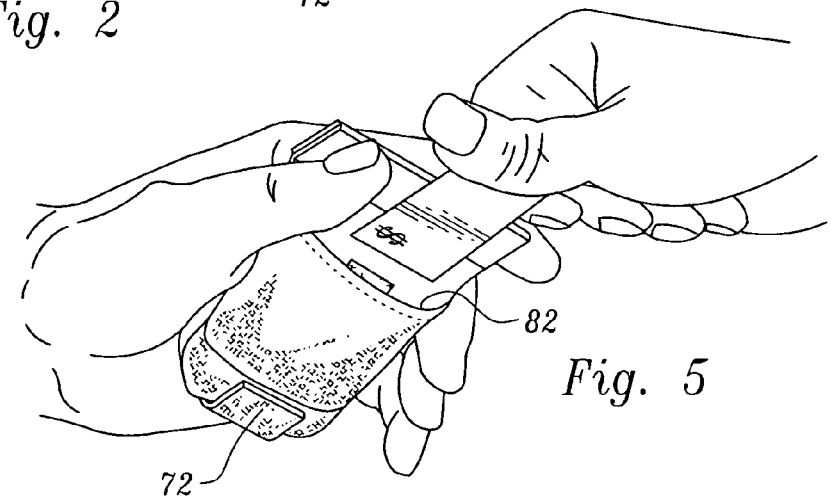
FIG. 5 is a back perspective view of an embodiment of the present invention showing insertion of personal property into a pocket which is hidden when the embodiment is worn, and wherein the pocket securely closes using a VELCRO® closure.
Figure 6:
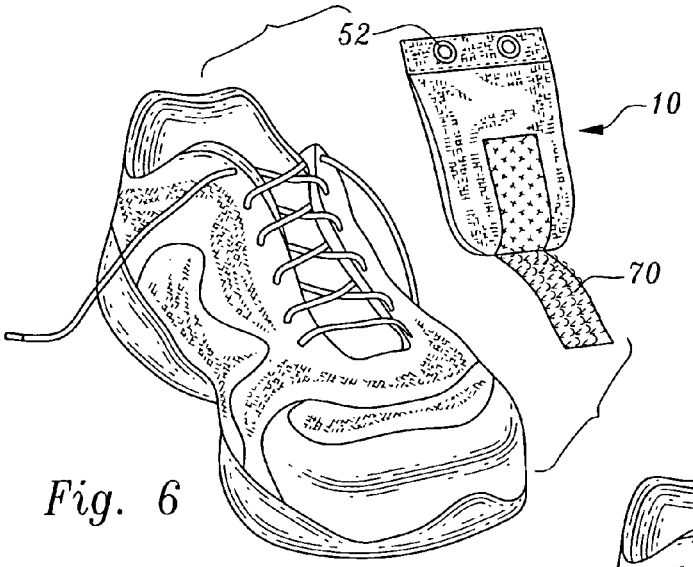
FIG. 6 is a top perspective view of a prior art shoe with an embodiment of the present invention showing means to secure the bottom of the shoe weight.
Figure 7:
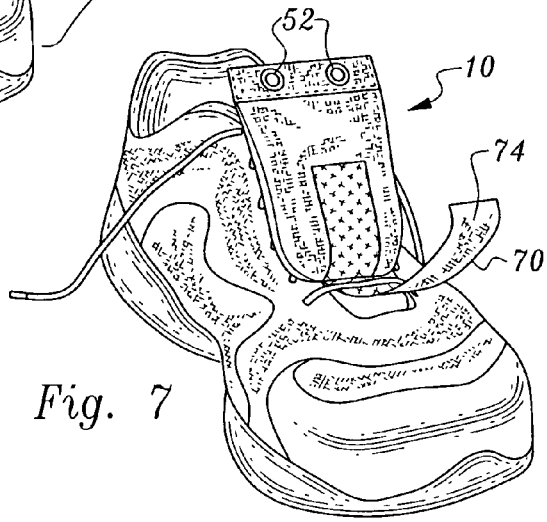
FIG. 7 is a top perspective view of a prior art shoe with an embodiment of the present invention showing fitting means to secure the bottom of the shoe weight to tied laces at the bottom of the shoe lace-box.
Figure 8:
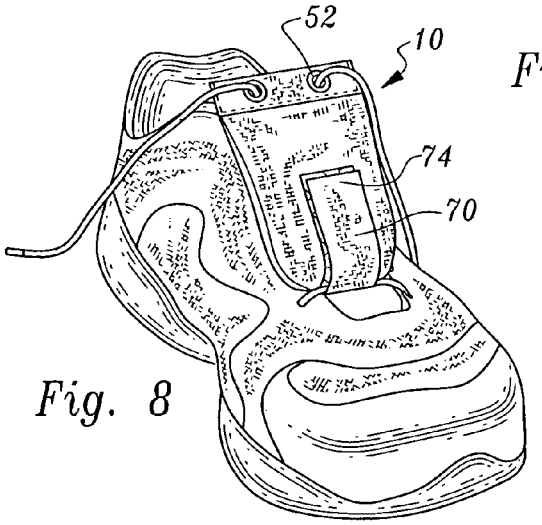
FIG. 8 is a top perspective view of a prior art shoe with an embodiment of the present invention showing fitting means to secure the top of the shoe weight to untied laces at the top of the shoe lace-box.
Figure 9:
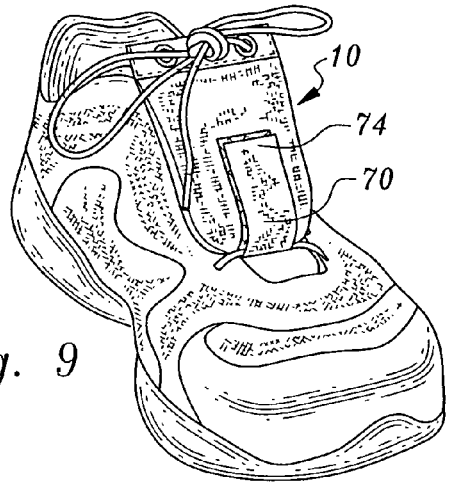
FIG. 9 is a top perspective view of a prior art shoe with an embodiment of the present invention showing fitting means to secure the top of the shoe weight tied to laces at the top of the shoe lace-box and secured under the tied lace bow.

The secure and hidden storage of small personal property items by the present invention is achieved by a pocket 80 having a single open top end 82 and three closed sides 84, FIGS. 2 and 5. The pocket closed sides are sewn to the packet back side and the pocket open top is directionally aligned towards and parallel to the packet stitched boundary and an unbounded edge of the flattened rectangle top side defining a predetermined volume sufficient to receive small personal property items, FIG. 5. The pocket open top end securely closes to house material placed within the pocket.

The loop side which securely attaches one loop end to a point on the packet top side longitudinal centerline, the attaching point on the packet top side, and the secure closure of the pocket open top end of the preferred embodiment of the present invention comprise attaching members with hook and loop self-gripping fastening devices of the type sold under the registered mark VELCRO®.

The flexible packet 10 material consists of heavy nylon, heavy cotton, heavy poly-vinyl, canvas, durable nylon canvas, neoprene, and durable, heavy synthetic fabric. Any of these materials may be treated to be water resistant or water repellant. The packet material of the present invention further comprises any solid colors of the art including, but not limited to, royal blue, red, yellow, navy, fuchsia, and black. The packet materials can also comprise a plurality of multi-color combinations according to user preference. The preferred embodiment of the present invention comprises a solid colored, flexible packet made from a durable nylon canvas.

As depicted in FIGS. 1–9, the preferred embodiment of the present invention for removable shoe weight for use in combination with a laced shoe comprises a flexible packet 10 with a longitudinal centerline aligned with the longitudinal axis of the shoe, a top stitched boundary side, a bottom side, a rounded bottom, a flattened rectangle top, and uniformly parallel sides. The packet uniformly parallel sides, rounded bottom, and top stitched boundary side are sewn together to define a predetermined volume sufficient to completely enclose a one pound weighted mass of solid steel pellets of uniform diameter of approximately 2–3 cm. Similarly, the stitching assembly of the present invention can be employed for any of the flexible and durable packet materials described herein.

The packet rounded bottom 40 further comprises a loop 70 of predetermined length having two sides and two ends, 72 and 74. One loop end 72 is fixedly attached to the packet bottom side 30 at a point on the packet longitudinal centerline such that the length of the loop extends around the packet rounded bottom 40 and under a predetermined tied shoelace, FIG. 7. The other loop end 74 is securely attached to a point on the packet top side 20 longitudinal centerline using hook and loop self-gripping fastening devices on the loop side joining the packet top side of the type sold under the registered mark VELCRO®, FIGS. 7 and 8. The loop 70 side not comprising VELCRO fastening devices may comprise reflective material known in the art.

The packet flattened rectangle top 50 further comprises two reinforced eyelets 52, each eyelet 52 spaced an equal distance between the stitched boundary and an unbounded edge of the flattened rectangle top 50 and from the packet longitudinal centerline. Each eyelet 52 receives a shoelace end directed from the packet bottom side 30 towards the packet top side 20 through the eyelet 52 allowing for the shoelace to be securely tied in a finished bowknot at the packet top side 20. Once the bowknot is tied the packet bottom side 30 is securely positioned against the tied shoelaces and contoured against the tied shoelaces along the top of the lace-box of the shoe which, when tied, conforms to the user's foot arch. In this manner, each user is assured a secure fit customized to the user's unique foot arch dimensions.

The packet bottom side 30 further comprises a pocket 80 having a single open top end 82 and three closed sides 84. The pocket closed sides are sewn to the packet bottom side 30 wherein the pocket open top 82 is directionally aligned towards and parallel to the stitched boundary and an unbounded edge of the flattened rectangle top 50 defining a predetermined volume sufficient to receive small personal property items, FIGS. 1–3, 5. This pocket further comprises a sewn VELCRO® closure comprising hook and loop self-gripping fastening devices of the type sold under the registered mark to securely close the pocket open top end 82. In this manner, the user can secure a key, money, or other small necessities undetectably in the shoe weights during exercise. In the preferred embodiment of the present invention, this pocket has an approximate 2 inch length and an approximate 2.5 inch width.

The removable shoe weights of the present invention can be formed in various sizes and weights. For maximum use and enjoyment, the preferred embodiment has outside dimensions of approximately 4 inches in longitudinal length, approximately 2.5 inches in width, an approximate filled thickness of 1–1⅛ inches, and a one pound weight per packet.

The present invention can be used by wearing even weight on each shoe, or by wearing uneven weights, or only one weight, depending on the user's specific training or exercise needs.

For shoe lace-boxes with extended lacing, more than one shoe weight of the present invention can be secured on the lace box consistent with the three point securing means as may be necessary to achieve the user's specific training or exercise needs. In such fashion, the eyelets 52 of any weights not secured at the top of the lace box become extensions of the lace-box eyelets or lace guides, and the laces are fed through the eyelets 52 and continue through the lace guides of the lace-box to the top where they are secured by a finished bowknot.

The accessability to the shoe-box and shoe laces provided by the present invention permits the user to combine lace held pedometers or lighting devices known in the art with the present invention. Embodiments of the present invention designed for the youth market include accessories for motion or impact initiated or generated audible frequencies or a light having a visible wavelength known in the art.

A latitude of modification, change and substitution is intended in the foregoing disclosure, and in some instances some features of the invention will be employed without a corresponding use of other features. Accordingly, it is appropriate that the appended claims be considered broadly and in a manner consistent with the spirit and scope of the invention herein.

I claim:

1. A removable shoe weight for use in combination with a laced shoe comprising:

a flexible packet consisting of a uniform material and having a longitudinal centerline aligned with the longitudinal axis of the shoe, the packet comprising a top side, a bottom side, a rounded bottom, a stitched top boundary, a flattened rectangular top, and uniformly parallel sides, and wherein the packet sides, rounded bottom, and stitched top boundary are sewn together to define a predetermined volume sufficient to completely enclose a predetermined weighted mass comprising uniformly sized spheres;

assembly for variably positioning and securing the flexible packet to at least three separate securing points on the shoelace of the shoe allowing adjustable positioning of the weighted mass alone the shoelace and securing the flexible packet once the shoelace is tied securely, the assembly comprising a loop of predetermined length having two sides and two ends, wherein one loop end is fixedly attached to the packet bottom side at a point on the packet longitudinal centerline such that the length of the loop extends around the packet rounded bottom under a predetermined tied shoelace and an assembly to securely attach the other loop end to a point on the packet top side longitudinal centerline, and two reinforced eyelets, each eyelet spaced an equal distance from the packet top and the packet longitudinal centerline, wherein each eyelet receives a shoelace end directed from the packet bottom side towards the packet top side through the eyelet allowing for the shoelace to be securely tied in a finished bowknot at the packet front side whereby, once the bowknot is tied, the packet backside is securely positioned and contoured against the tied shoelaces along the top of the user's foot arch; and a pocket comprising closed sides being sewn to the packet back side wherein the pocket open top is directionally aligned towards and parallel to the packet flattened rectangular top side defining a predetermined volume sufficient to receive small personal property items, and comprising assembly to securely close the pocket open top end.

2. The removable shoe weight of claim 1, wherein assembly to securely attach the other loop end to a point on the packet top side longitudinal centerline, and assembly to securely close the pocket open top end further comprise hook and loop self-gripping fastening devices.

3. The removable shoe weight of claim 2, wherein sphere composition is selected from the group consisting of ceramic and metal.

4. The removable shoe weight of claim 3, wherein sphere diameter is 2–3 cm.

5. The removable shoe weight of claim 3, wherein the flexible packet material is selected from the group consisting of heavy nylon, heavy cotton, heavy poly-vinyl, canvas, durable nylon canvas, neoprene, and durable, heavy synthetic fabric.

6. The removable shoe weight of claim 5, wherein the predetermined weighted mass is less than one pound.

7. The removable shoe weight of claim 5, wherein the predetermined weighted mass is at least one pound.

8. The removable shoe weight of claim 5, wherein the loop side not comprising hook and loop self-gripping fastening devices comprises a reflective material.

9. The removable shoe weight of claim 8, wherein the flexible packet material is water repellant.

10. The removable shoe weight of claim 8, wherein the flexible packet material is water resistant.

11. A removable shoe weight for use in combination with a laced shoe comprising:

a flexible packet comprising a longitudinal centerline aligned with the longitudinal axis of the shoe, a top side, a bottom side, a rounded bottom, a flattened rectangular top, and uniformly parallel sides, and wherein the packet sides, rounded bottom, and flattened rectangular top are sewn together to define a predetermined volume sufficient to completely enclose a predetermined weighted mass of solid steel pellets, wherein the pellets have uniform diameters of approximately 2–3 cm;

wherein the packet rounded bottom further comprises a loop of predetermined length having two sides and two ends, wherein one loop end is fixedly attached to the packet bottom side at a point on the packet longitudinal centerline such that the length of the loop extends around the packet rounded bottom under a predetermined tied shoelace and the other loop end is securely attached to a point on the packet top side longitudinal centerline using hook and loop self-gripping fastening devices on one loop side and the packet top side, and wherein the other loop side comprises a reflective material;

wherein the packet flattened rectangular top further comprises two reinforced eyelets, each eyelet spaced an equal distance from the packet top and the packet longitudinal centerline, wherein each eyelet receives a shoelace end directed from the packet bottom side towards the packet top side through the eyelet allowing for the shoelace to be securely tied in a finished bowknot at the packet front side, and wherein once the bowknot is tied the packet backside is securely positioned against the tied shoelaces and contoured against the tied shoelaces at a predetermined variable position along the top of the user's foot arch; and wherein the packet bottom side further comprises a pocket having a single open top end and three closed sides, the pocket closed sides being sewn to the packet bottom side wherein the pocket open top is directionally aligned towards and parallel to the packet flattened rectangular top side defining a predetermined volume sufficient to receive small personal property items, and comprising a sewn closure with hook and loop self-gripping fastening devices to securely close the pocket open top end.

12. The removable shoe weight of claim 11, wherein the packet is selected from the group consisting of heavy nylon, heavy cotton, heavy poly-vinyl, canvas, durable nylon canvas, neoprene, and durable, heavy synthetic fabric.

13. The removable shoe weight of claim 12, wherein the flexible packet material is water repellant.

14. The removable shoe weight of claim 12, wherein the flexible packet material is water resistant.

* * * * *